US009926185B2

(12) United States Patent
Davis et al.

(10) Patent No.: US 9,926,185 B2
(45) Date of Patent: Mar. 27, 2018

(54) FLUID TRANSFER LID

(71) Applicant: NEOMED, INC., Woodstock, GA (US)

(72) Inventors: Benjamin M. Davis, Woodstock, GA (US); Aaron N. Ingram, Canton, GA (US)

(73) Assignee: NEOMED, INC., Woodstock, GA (US)

( * ) Notice: Subject to any disclaimer, the term of this patent is extended or adjusted under 35 U.S.C. 154(b) by 0 days.

(21) Appl. No.: 14/960,905

(22) Filed: Dec. 7, 2015

(65) Prior Publication Data

US 2016/0159635 A1 Jun. 9, 2016

Related U.S. Application Data

(60) Provisional application No. 62/088,850, filed on Dec. 8, 2014.

(51) Int. Cl.

| | |
|---|---|
| ***B65D 55/16*** | (2006.01) |
| ***B67D 3/00*** | (2006.01) |
| ***B65D 51/18*** | (2006.01) |
| ***B65D 47/06*** | (2006.01) |
| ***B65D 47/14*** | (2006.01) |
| ***A61J 1/14*** | (2006.01) |

(52) U.S. Cl.

CPC ..... *B67D 3/0041* (2013.01); *A61J 1/1418* (2015.05); *A61J 1/1487* (2015.05); *B65D 47/06* (2013.01); *B65D 47/147* (2013.01); *B65D 51/18* (2013.01); *B65D 55/16* (2013.01); *B67D 3/0051* (2013.01); *B67D 3/0083* (2013.01); *B67D 3/0093* (2013.01)

(58) Field of Classification Search

CPC .. B67D 3/0041; B67D 3/0083; B67D 3/0093; B67D 3/0051; A61J 1/1487; A61J 1/1418; B65D 47/06; B65D 47/147; B65D 51/18; B65D 55/16

USPC ..... 604/403, 415, 407, 905; 215/306, 307, 215/310, DIG. 3, 329, 388, 389; 220/254.1, 254.3, 375, 709

See application file for complete search history.

(56) References Cited

U.S. PATENT DOCUMENTS

| | | | | |
|---|---|---|---|---|
| 3,307,752 A * | 3/1967 | Anderson | ..... | B65D 23/108 215/306 |
| 4,493,348 A | 1/1985 | Lemmons | | |
| 4,508,236 A | 4/1985 | Keilman et al. | | |
| 4,883,483 A | 11/1989 | Lindmayer | | |
| 4,944,736 A | 7/1990 | Holtz | | |

(Continued)

FOREIGN PATENT DOCUMENTS

| | | |
|---|---|---|
| WO | 9803210 A2 | 1/1998 |
| WO | 2005065767 A2 | 7/2005 |

(Continued)

OTHER PUBLICATIONS

Baxter AdaptACap Bottle Adapter; 1 pg; date unknown.

(Continued)

*Primary Examiner* — Kareen Thomas

(74) *Attorney, Agent, or Firm* — Gardner Groff Greenwald & Villanueva, PC

(57) ABSTRACT

A fluid transfer lid for removably coupling to pharmacy bottles or containers for withdrawing and/or delivering liquid medication or other fluid therefrom or thereto. In example forms, a syringe comprising a male or female connection tip couples with a transfer port of the lid, thereby allowing the transfer of fluids from the container and to the syringe.

15 Claims, 14 Drawing Sheets

(56) References Cited

U.S. PATENT DOCUMENTS

| | | | | |
|---|---|---|---|---|
| 5,090,583 | A * | 2/1992 | Hoffman | B65D 47/147 215/250 |
| 5,356,406 | A | 10/1994 | Schraga | |
| 5,429,256 | A | 7/1995 | Kestenbaum | |
| 5,454,409 | A | 10/1995 | McAffer et al. | |
| 5,484,070 | A | 1/1996 | Graham | |
| 5,573,525 | A | 11/1996 | Watson et al. | |
| 5,598,939 | A | 2/1997 | Watson et al. | |
| D528,910 | S | 9/2006 | Kingsley | |
| D530,200 | S | 10/2006 | Kingsley | |
| 7,717,281 | B2 | 5/2010 | Baudin | |
| D627,899 | S | 11/2010 | Cofie | |
| D630,732 | S | 1/2011 | Lev et al. | |
| 8,245,870 | B2 * | 8/2012 | McKinney | A47G 19/2266 215/306 |
| D674,277 | S | 1/2013 | Hanson et al. | |
| D686,339 | S | 7/2013 | Shima et al. | |
| D693,923 | S | 11/2013 | Hernandez et al. | |
| D706,135 | S | 6/2014 | Hutchison et al. | |
| D714,142 | S | 9/2014 | Hojo | |
| 8,926,840 | B2 * | 1/2015 | Hull | A47G 19/2266 210/282 |
| D723,181 | S | 2/2015 | Kawamura | |
| D725,284 | S | 3/2015 | Karlsson et al. | |
| 9,156,569 | B2 | 10/2015 | Vassallo et al. | |
| 9,296,531 | B2 | 3/2016 | Luzbetak et al. | |
| 9,433,562 | B2 | 9/2016 | Ingram et al. | |
| 2008/0087624 | A1 * | 4/2008 | Buckley | A47G 23/16 215/230 |
| 2009/0230075 | A1 * | 9/2009 | Springer | B65D 47/247 215/228 |
| 2011/0054436 | A1 | 3/2011 | Griffis, III et al. | |
| 2012/0103470 | A1 | 5/2012 | Terwilliger et al. | |
| 2012/0104054 | A1 | 5/2012 | Terwilliger et al. | |
| 2014/0246616 | A1 | 9/2014 | Fangrow | |
| 2016/0159635 | A1 | 6/2016 | Davis et al. | |
| 2016/0217679 | A1 | 7/2016 | McNutt et al. | |

FOREIGN PATENT DOCUMENTS

| | | | |
|---|---|---|---|
| WO | 2009068987 | A1 | 6/2009 |
| WO | 2013081699 | A2 | 6/2013 |

OTHER PUBLICATIONS

Total Pharmacy Supply Bottle Adapter Plug; 1 pg; date unknown.
Total Pharmacy Supply Universal Bottle Adapter; 1 pg; date unknown.
Medela Breastmilk Transfer Lid; 1 pg; date unknown.
International Search Report & Written Opinion for PCT/US2015/064237; 12 pgs; Mar. 3, 2016.
Medispense Stepped Stopper; 1 pg; date unknown.
Medi-Dose EPS Press-In Bottle Adapters; 1 pg; date unknown.
Iso-Med Press-In Bottle Adapters; 1 pg; date unknown.
PDG—The Packaging Design Group Sealsafe Press in Bottle Adapter (PIBA); 1 pg; date unknown.
Medicina ENFit Press in Adapter; 18 pgs; date unknown.
WestPharma Vial Adapters; 2 pgs; 2014.
BioJect Needle-Free Vial Adapter; 1 pg; date unknown.
CareFusion Universal Vented Vial Adapter; 2 pgs; 2013.
NeoMed Closed System NeoBottle; 1 pg; date unknown.
Alternative Syringes Low Displacement Option PowerPoint Presention; Presented by Rork Swisher of Covidien; ISO 80369 Series Meeting; Berlin Germany; 11 pgs; Mar. 19, 2014.pgs.
Baxa (Baxter) RAPIDFILL Connector; date unknown; 1 pg.
New ISO Tubing Connector Standards: A Follow-Up to the Sentinel Event Alert Webinar PowerPoint Presention; www.jointcommission.org; 50 pgs; Dec. 3, 2014.
New Tube Feeding Connectors Webinar PowerPoint Presention; www.oley.org; 24 pgs; Jun. 24, 2014.
Invitation to Pay Additional Fees for PCT/US2017/019021; dated Jun. 6, 2017; 12 pgs.

* cited by examiner

| SIZE | $D_1$ | | $H_1$ | $L_2$ | $L_1$ | WEIGHT (g) | |
|---|---|---|---|---|---|---|---|
| | INDICATED | MEASURED | | | | | |
| A | 18 | 17.76 | 9.81 | 62.01 | 73.67 | 2.12 | |
| B | 20 | 19.69 | 9.81 | 60.39 | 73.52 | 2.41 | |
| C | 22 | 21.83 | 12.85 | 59.73 | 75.11 | 2.89 | |
| D | 24 | 22.99 | 11.99 | 50.28 | 73.19 | 3.11 | |
| E | 28 | 27.34 | 10.88 | 57.24 | 75.53 | 3.05 | |
| F | 28 | 27.52 | 19.27 | 56.36 | 75.76 | 4.81 | |
| G | 33 | 31.61 | 11.09 | 54.77 | 74.65 | 3.86 | |
| H | 33 | 31.82 | 20.63 | 54.37 | 76.42 | 5.05 | |
| K | 28 | 27.47 | 15.19 | 56.65 | 75.52 | 3.79 | |
| M | 24 | 23.36 | 12.19 | 58.95 | 74.14 | 3.14 | |

FIG. 17

FLUID TRANSFER LID

CROSS-REFERENCE TO RELATED APPLICATION

This application claims the priority benefit of U.S. Provisional Patent Application Ser. No. 62/088,850 filed Dec. 8, 2014, which is hereby incorporated by reference herein.

TECHNICAL FIELD

The present invention relates generally to the field of containment, storage, and delivery of fluids, particularly in the medical and pharmaceutical fields, and more particularly to a transfer lid for pharmacy bottles or other containers for transferring fluids such as oral liquid medications.

BACKGROUND

Various containers are used for the collection, storage and delivery of fluids such as medications, supplements, breast milk, formula, and the like. For example, when dispensing fluid medications that are commonly stored in larger volumes in a pharmacy bottle, and dispensed in smaller prescribed quantities into a smaller container, a syringe may be used to measure and transfer the fluid. Often a transfer lid or cap is used on the larger volume container, allowing easy repeated dispensation from the container.

Continued improvements to the transfer and dispensation of fluids such as fluid medications is sought. It is to the provision of an improved fluid transfer lid meeting these and other needs that the present invention is primarily directed.

SUMMARY

In example embodiments, the present invention provides a fluid transfer lid for providing the transfer of fluids from a pharmacy bottle or other container to a syringe or other fluid transfer means. In example forms, the fluid transfer lid includes a male nipple or coupling for removable and sealing engagement with a female coupling tip of the syringe.

In one aspect, the present invention relates to a fluid transfer lid having a nipple or coupling extending longitudinally along a first axis and having a chamfer formed at an end thereof. The nipple has a length, an outside diameter near the chamfer of between about 5.36 millimeters to about 5.46 millimeters, and an outside diameter near the surface of between about 5.59 millimeters to about 5.69 millimeters. A lumen extends generally axially along the first axis through the nipple and has a diameter of between about 0.1 millimeters to about 2.95 millimeters. Optionally, a tethered closure cap is attached to the lid for removable engagement and closure of the nipple.

According to one example form, the length of the nipple is between about 0.1 millimeters and 1,000 millimeters. Optionally, the length of the nipple is about 6.82 millimeters. In some example forms, the fluid transfer lid includes a cooperating connector having an outer housing or collar surrounding the nipple. The outer housing or collar is threaded on an internal portion thereof and defines a root width between about 1.05-1.25 millimeters, a crest width between about 1.80-2.00 millimeters, and a pitch width between about 2.45-2.55 millimeters.

In another aspect, the present invention relates to fluid transfer lid including a generally circular top panel, a nipple, and an attachment collar. The nipple has a length and extends longitudinally along a first axis from a generally central position of the circular top panel. In example forms, the nipple includes a chamfer formed at an end thereof and a lumen extending generally axially along the first axis therethrough. The attachment collar extends in a second direction from the circular top panel whereby an internal circumferential face thereof is threaded to releasably engage corresponding threads of a container.

In yet another aspect, the present invention relates to a fluid transfer lid for interengagement with a syringe having a dosing control coupling. The fluid transfer lid includes a generally circular top panel and a transfer port extending from a generally central position on the circular top panel outwardly in a first direction, and an attachment collar extending in a second and generally opposite direction from the top panel whereby an internal circumferential face thereof includes one or more threads for releasably engaging corresponding threads of a container. In example forms, the transfer port defines a lumen generally axially extending therethrough, and whereby the dosing control coupling comprises a generally centrally-positioned low dose tip for being received within the lumen of the transfer port when the syringe is coupled to the transfer port.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

BRIEF DESCRIPTION OF THE DRAWINGS

FIG. 17 shows a chart showing example dimensions of the fluid transfer lid according to example embodiments of the present invention.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
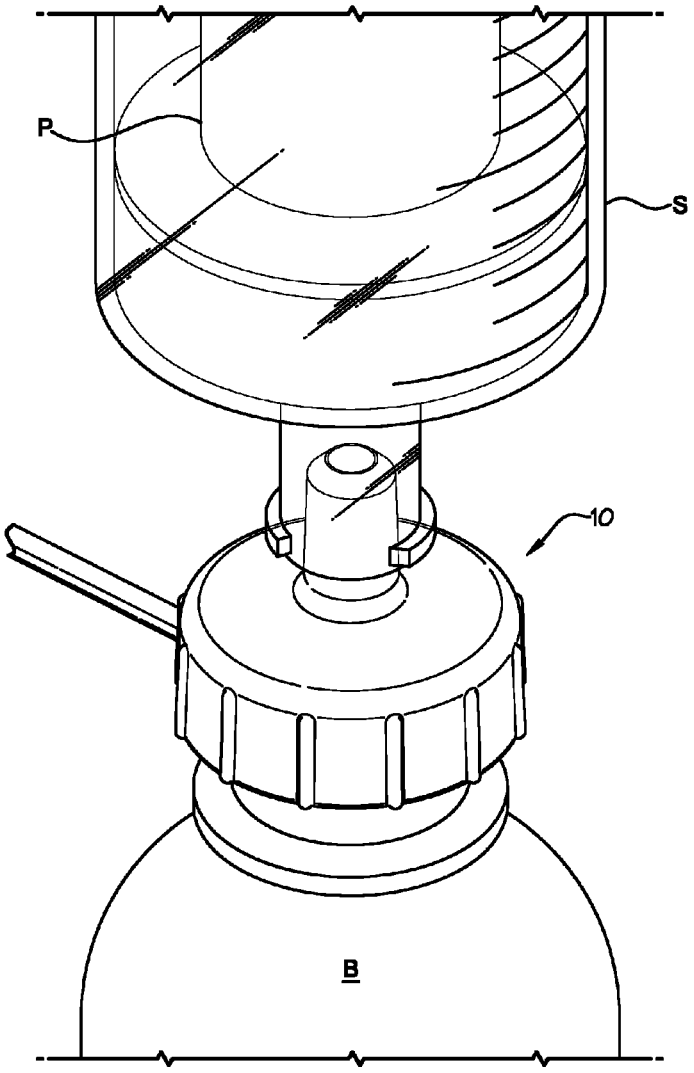
FIG. 1 is a perspective view of a fluid transfer lid attached to a pharmacy bottle according to an example embodiment of the present invention, and showing a syringe coupled to the fluid transfer lid for transferring fluids from the pharmacy bottle to the syringe.

With reference now to the drawing figures, wherein like reference numbers represent corresponding parts throughout the several views, FIG. 1 shows a fluid transfer lid 10 removably coupled to a pharmacy bottle or container B and comprising a syringe S coupled thereto according to an example embodiment of the present invention. With the fluid transfer lid 10 removably mounted to the container B, fluids or medicine contained within the container B can be withdrawn or transferred therefrom and into the syringe S. In typical embodiments, the container B generally comprises a containment shell enclosing a contained volume for containment of the fluids (e.g., pharmacy bottles generally contain fluid medicine). To transfer fluids from the container, the fluid transfer lid 10 is removably coupled to the container B (the container being positioned upright) and the syringe is coupled to a transfer port or nipple 24 that is extending from a top panel 22 of the fluid transfer lid 20 (see FIG. 2). With a plunger P being movably and sealingly engaged with the syringe S, the container B is positioned upside-down and the fluids from the container B began to enter into the syringe S. The plunger P can slowly retract to withdrawal fluid therefrom and ensure that the appropriate amount of fluid is transferred from the container B and into the syringe S.

Figure 2:
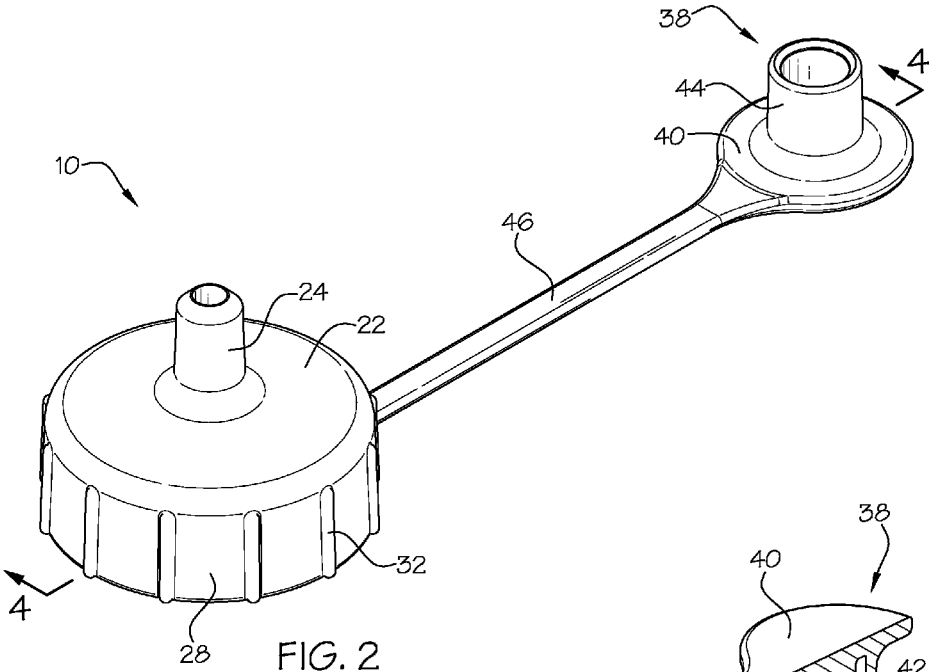
FIG. 2 is a perspective view of the fluid transfer lid of FIG. 1.
Figure 3:
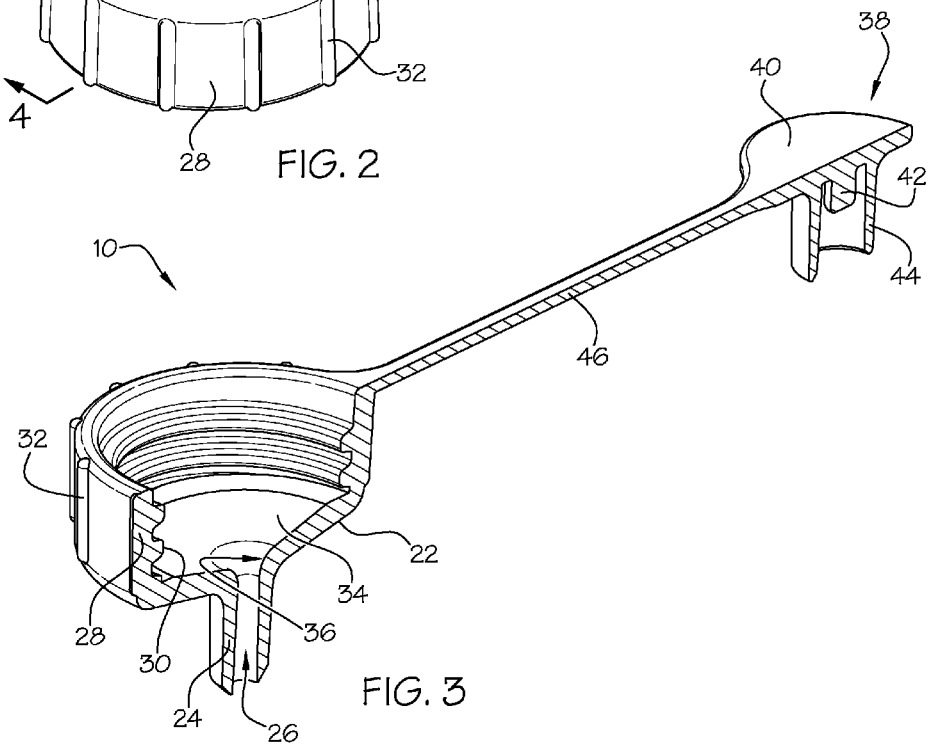
FIG. 3 is a perspective cross-sectional view of the fluid transfer lid of FIG. 2.
Figure 4:
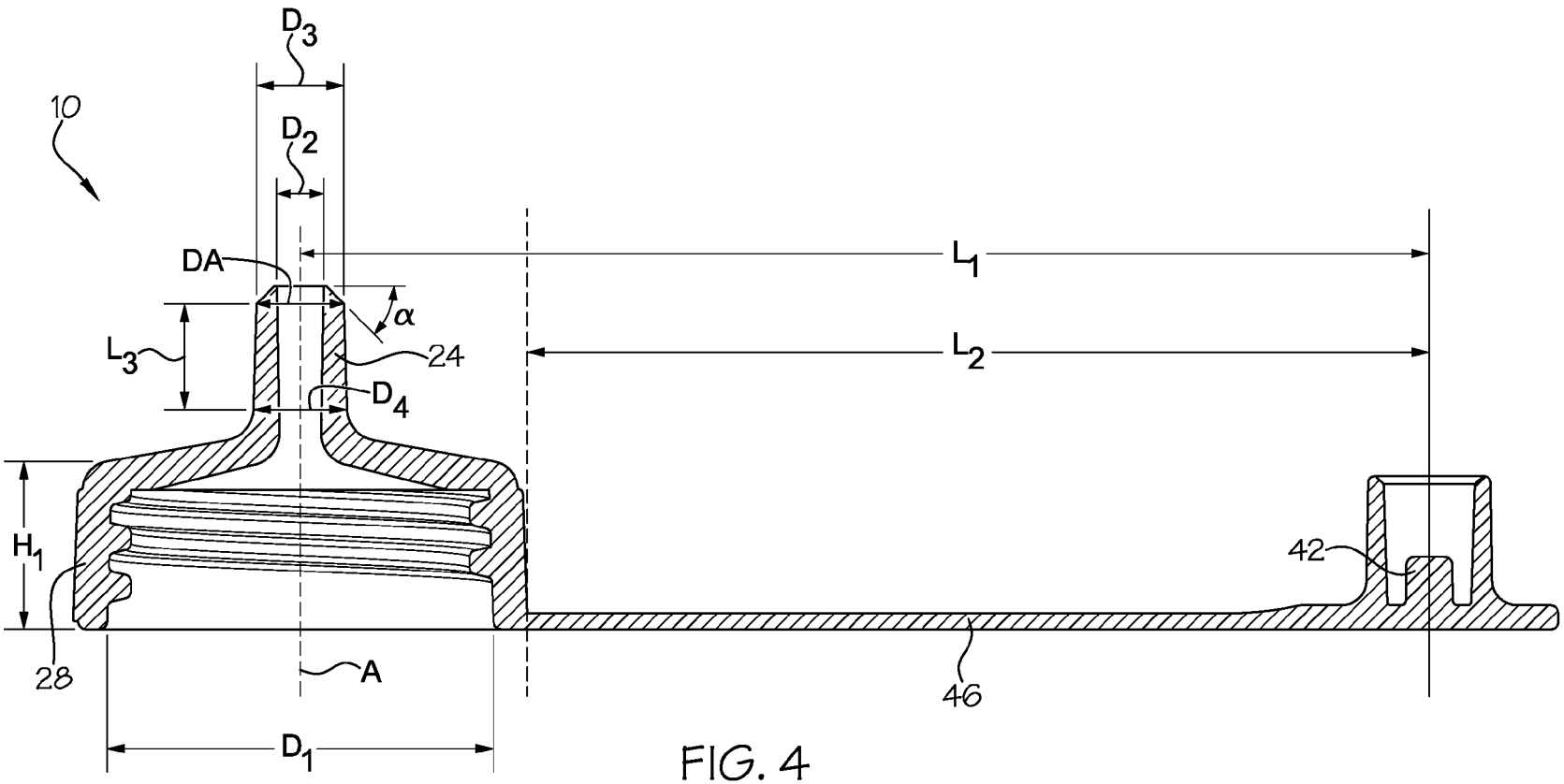
FIG. 4 is a cross-sectional view of the fluid transfer lid of FIG. 2 taken along line 4-4.

FIGS. 2-4 show the fluid transfer lid 10 in greater detail. In example embodiments, the fluid transfer lid 10 comprises the generally circular top panel 22 with the transfer port 24 extending from a generally central position on the top panel 22 outwardly in a first or distal direction. An attachment collar 28 extends in a second or proximal direction from the top panel 22, and an internal circumferential face thereof is threaded to releasably engage corresponding threads at the top of the containment shell of the container B. An exterior circumferential face of the attachment collar 28 of the fluid transfer lid 10 optionally comprises spaced intentions, ridges, recesses, or other gripping features 32 to assist a user in installing and removing the transfer lid onto and from the containment shell of the container B. Optionally, a port closure cap 38 is attached to the fluid transfer lid 10 by a tether 46, which defines a flange or lip 40 comprising a plug or cover 42 and a secondary cover or lip 44 extending therefrom in the first direction (see FIGS. 3-4). The plug 42 is preferably provided for removable engagement and closure of the transfer port 24, for example, to be inserted within at least a portion of the lumen 26 extending axially through the transfer port 26. Generally, the lumen 26 defined within the transfer port 24 is what generally defines the volumetric channel whereby the fluids are permitted to flow from the container B to the syringe S. In example embodiments, the tether is integrally formed with the port closure cap 38 and the lid 10, and thus, permanently attach the two together. Alternatively, the end of the tether can comprise a ring or engagement feature for engagement with the lid 10, for example, whereby a radial channel is provided along the base of the transfer port 24 or the attachment collar 28 for the ring of the tether to engage. Optionally, other forms of rigid or pivotal attachment (e.g., removable or permanent) may be chosen as desired.

The threads 30 and the attachment collar 28 are optionally configured and sized to fit various other containers B including other pharmacy bottles, breast milk containers, or other containers, etc. as desired. As shown in FIG. 4, a diameter D1 is defined by the diameter of the internal circumferential face of the attachment collar 28 of the fluid transfer lid 10, and a height H1 is defined by the extension of the attachment collar 28 from the top panel 22. According to one example embodiment, the diameter D1 is about 22 millimeters, more preferably about 23 millimeters, and more preferably about 22.99 millimeters; and the height H1 is about 12 millimeters, and more preferably about 11.99 millimeters. Optionally, the diameter D1 and the height H1 can be chosen as desired according to the threads and diameter of the opening of the container B. According to example forms, the diameter D1 is generally between about 5 millimeters to about 100 millimeters. As depicted in FIG. 17, a chart shows approximations for various diameters D1 and corresponding heights H1 according to some example embodiments of the present invention. In example forms, sizes are categorized by letter (e.g., sizes A-H, K and M) to define certain heights, diameters, and lengths. For example, a length L1 is defined between an axis A (extending axially along a lumen 26 of the transfer port) and a central axis of the plug 42 of the port closure cap 38. Additionally, a length L2 is defined between an outer peripheral surface of the attachment collar 28 and the central axis of the plug 42. Optionally, the diameter D1, height H1 and lengths L1, L2 can be sized as desired to provide for removable engagement with other containers B of various sizes.

In example forms, the transfer port 24 comprises an ENFit connector or male nipple compatible and/or compliant with ISO 80369-3 standards, which provides for a slip/friction connection with an ENFit connector or female tip (according to ISO 80369-3 standards) of the syringe S. Accordingly, the length L3 of the transfer port 24 is about 6.82 millimeters, the diameter D2 of the lumen 26 or the inside diameter of the transfer port 24 is between about 0.01-2.95 millimeters, more preferably about 2.90 millimeters, the outside diameter D3 at the tip of the chamfer or taper is between about 5.36-5.46 millimeters, more preferably about 5.41 millimeters, the outside diameter D4 of the transfer port 24 generally near or above the top surface 22 is between about 5.59-5.69 millimeters, more preferably about 5.64 millimeters, the angle of taper DA of the transfer port 24 is about a 6% taper or about 3.44 degrees (nominal), and the angle $\alpha$ of the chamfer is between about 40-50 degrees, more preferably about 45 degrees. Optionally, the length L3 of the transfer port 24 can be sized as desired, for example, generally between about 0.1 millimeters to about 1,000 millimeters. In example embodiments where the nipple has a length greater than about 6.82 millimeters, the outside diameter D4 near the top surface 22 can vary (larger or smaller) as desired. According to one example form, the diameter of the nipple measured at about 6.82 millimeters from the tip is generally between about 5.59-5.69 millimeters, regardless of the length L3 of the nipple.

Referring back to FIG. 3, generally opposite the top panel 22 defines an interior sloped surface 34, which is generally circular and extends around the lumen 26 of the transfer port 24. Preferably, a radiused transition 36 is provided between the interior sloped surface 34 and an internal portion of the transfer port 24, thereby forming a funnel-like shape on the interior of the transfer lid 10. Preferably, with the interior sloped surface 34 and the radiused transition 36, fluid medicine or other fluids flow easier through the lumen 26 of the transfer port 24 and into the syringe S. More preferably, when considering fluid medicine, the radiused transition 36 preferably provides benefit to the medicine being transferred therethrough, for example, wherein the fluid medicine is not subjected to the amount of shear or other forces that are generally caused by interaction between the fluid and an interior of the lid. Thus, it is preferred that the interior sloped surface 34 and the radiused transition 36 provide a less agitated or disturbed transfer of fluids between the container B and the syringe S.

Optionally, an inner collar may be positioned on the interior sloped surface 34 near the attachment collar 28, which would have a diameter that would be less than the diameter of the internal circumferential face D1 by a dimension selected to define spacing between the attachment collar and the inner collar corresponding to the material thickness of the containment shell around its upper rim. Optionally, a vent slot is provided therethrough for allowing air to vent to or from the contained volume of the container B, for example, as disclosed in U.S. Non-provisional patent application Ser. No. 14/844,910, hereby incorporated herein by reference, and showing an example inner collar comprising a vent slot.

Figure 5:
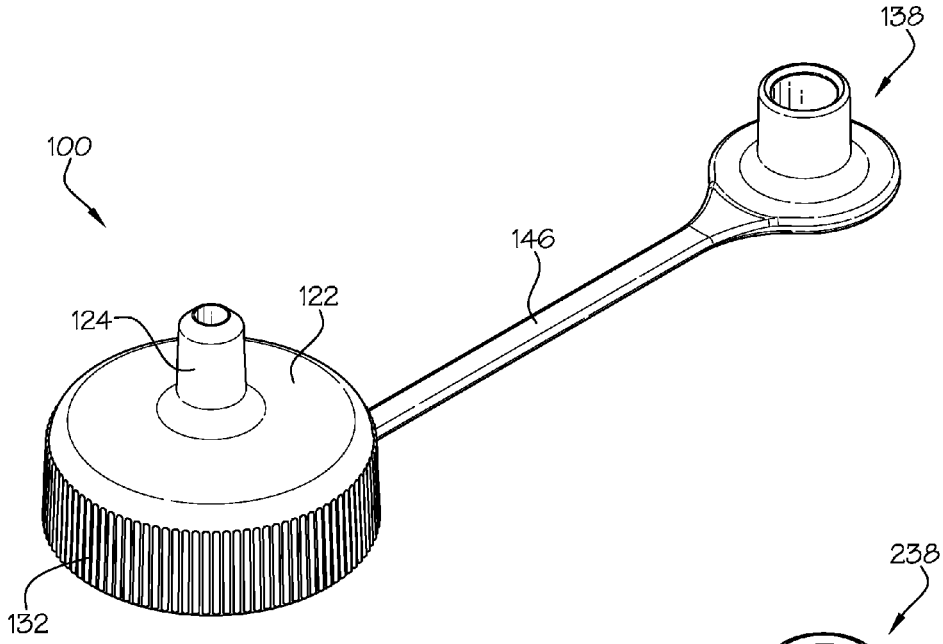
FIG. 5 is a perspective view of a fluid transfer lid according to another example embodiment of the present invention.

FIG. 5 shows a fluid transport lid 100 according to another example embodiment of the present invention, which is substantially similar to the fluid transfer lid 10, as described above. Preferably, an exterior circumferential face of the attachment collar 128 of the fluid transfer lid 100 comprises closely-spaced indentations or gripping features 32 to assist a user in installing and removing the transfer lid onto and from the containment shell of the container B. In the depicted embodiment, the gripping features 132 are generally closely-spaced elongate, ridge-like indentations formed along the exterior circumferential face. Optionally, gripping features of other shapes, sizes, pattern, etc. can be chosen as desired.

Figure 6:
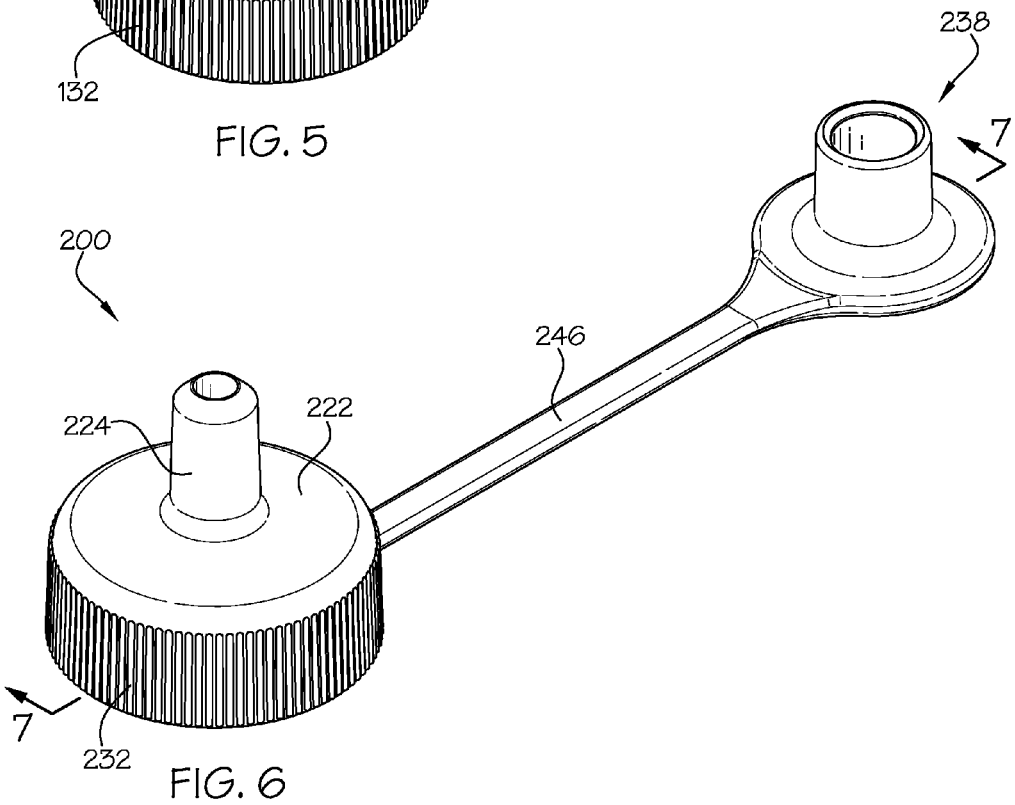
FIG. 6 is a perspective view of a fluid transfer lid according to another example embodiment of the present invention.
Figure 7:
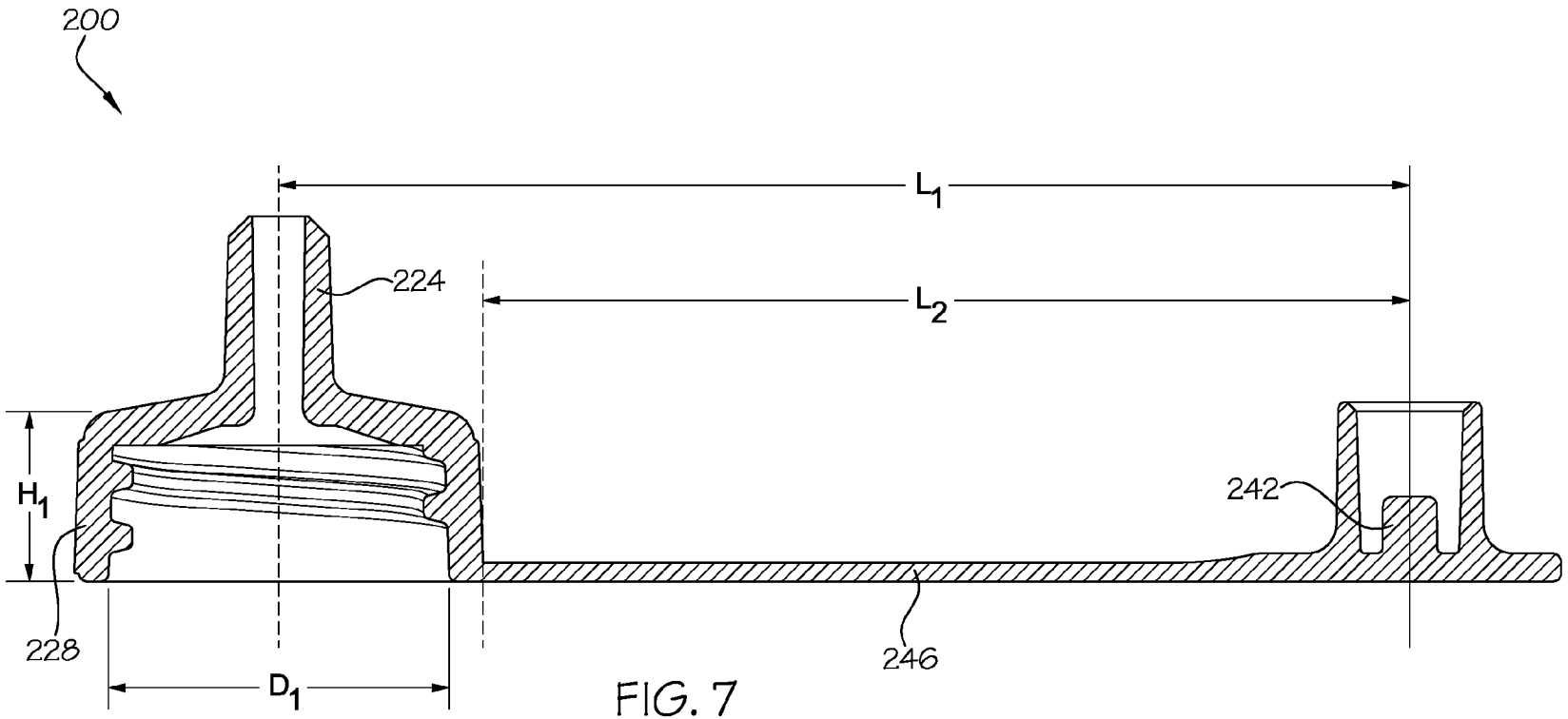
FIG. 7 is a cross-sectional view of the fluid transfer lid of FIG. 6 taken along line 7-7.
Figure 8:
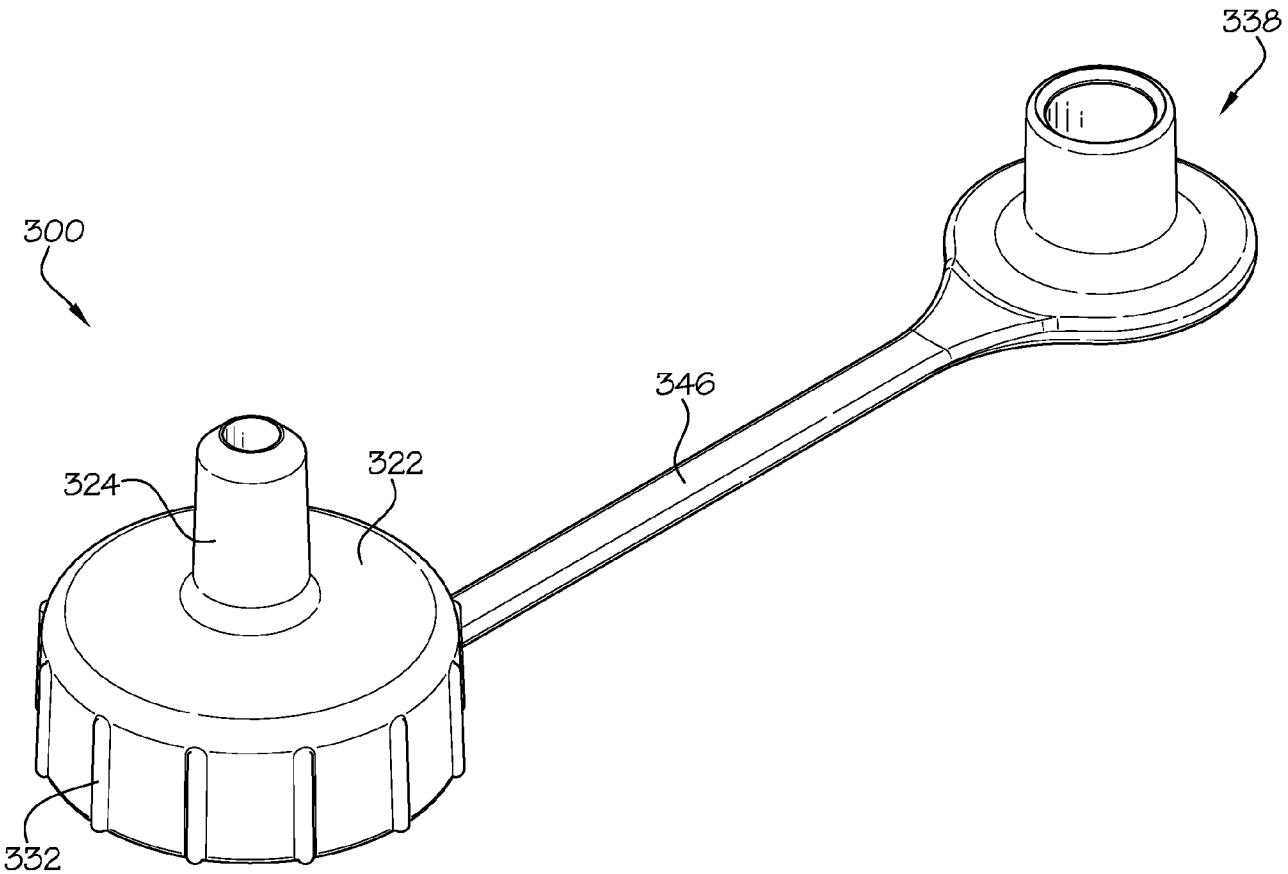
FIG. 8 is a perspective view of a fluid transfer lid according to another example embodiment of the present invention.

FIGS. 6-8 show fluid transfer lids 200, 300 according to another example embodiment of the present invention. As shown, the fluid transfer lids 200, 300 are substantially similar, except that fluid transfer lid 200 comprises closely-spaced gripping features 232 whereas fluid transfer lid 300 comprises spaced-apart gripping features 332 forming a larger indentation than those of fluid transfer lid 200. As shown in FIG. 7, the fluid transfer lid comprises a diameter D1 of about 17.76 millimeters, a height H1 of about 9.81 millimeters, a length L1 of about 73.67 millimeters, and a length L2 of about 62.01 millimeters.

Figure 9:
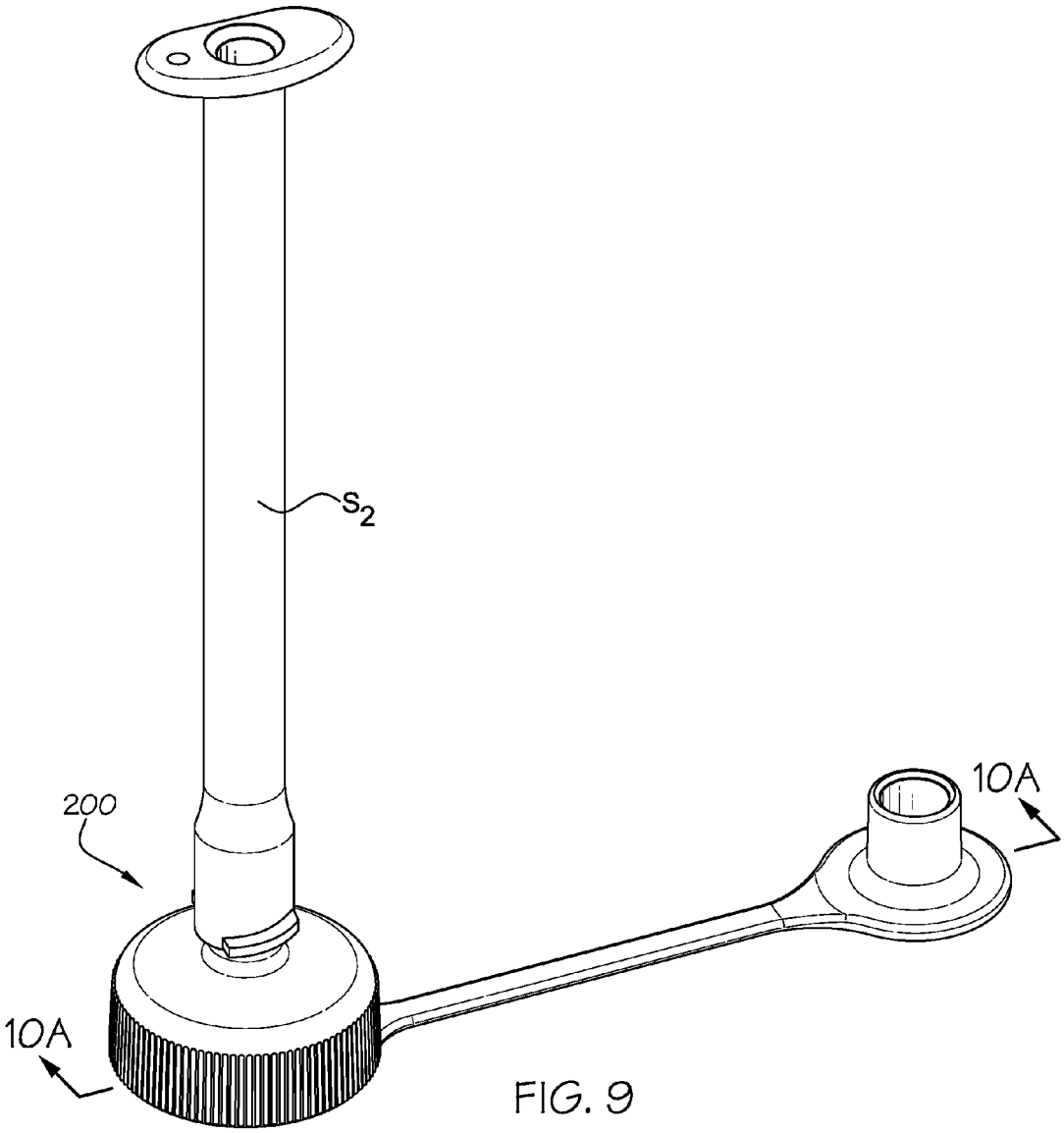
FIG. 9 is a perspective view of the fluid transfer lid of FIG. 6, showing a syringe being coupled thereto.
Figure 10A:
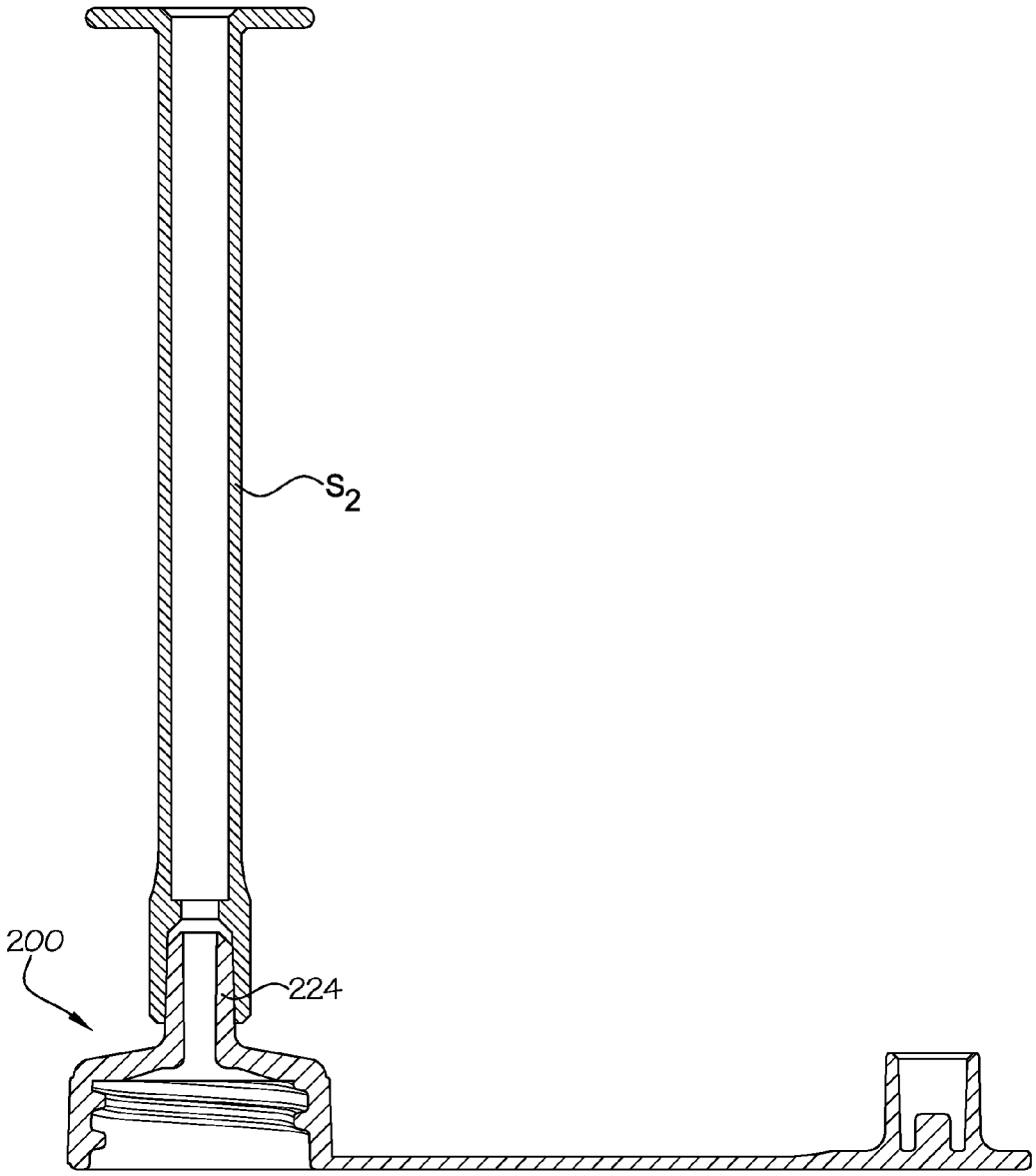
FIG. 10A is a cross-sectional view of the fluid transfer lid and syringe of FIG. 9 taken along line 10A-10A.
Figure 10B:
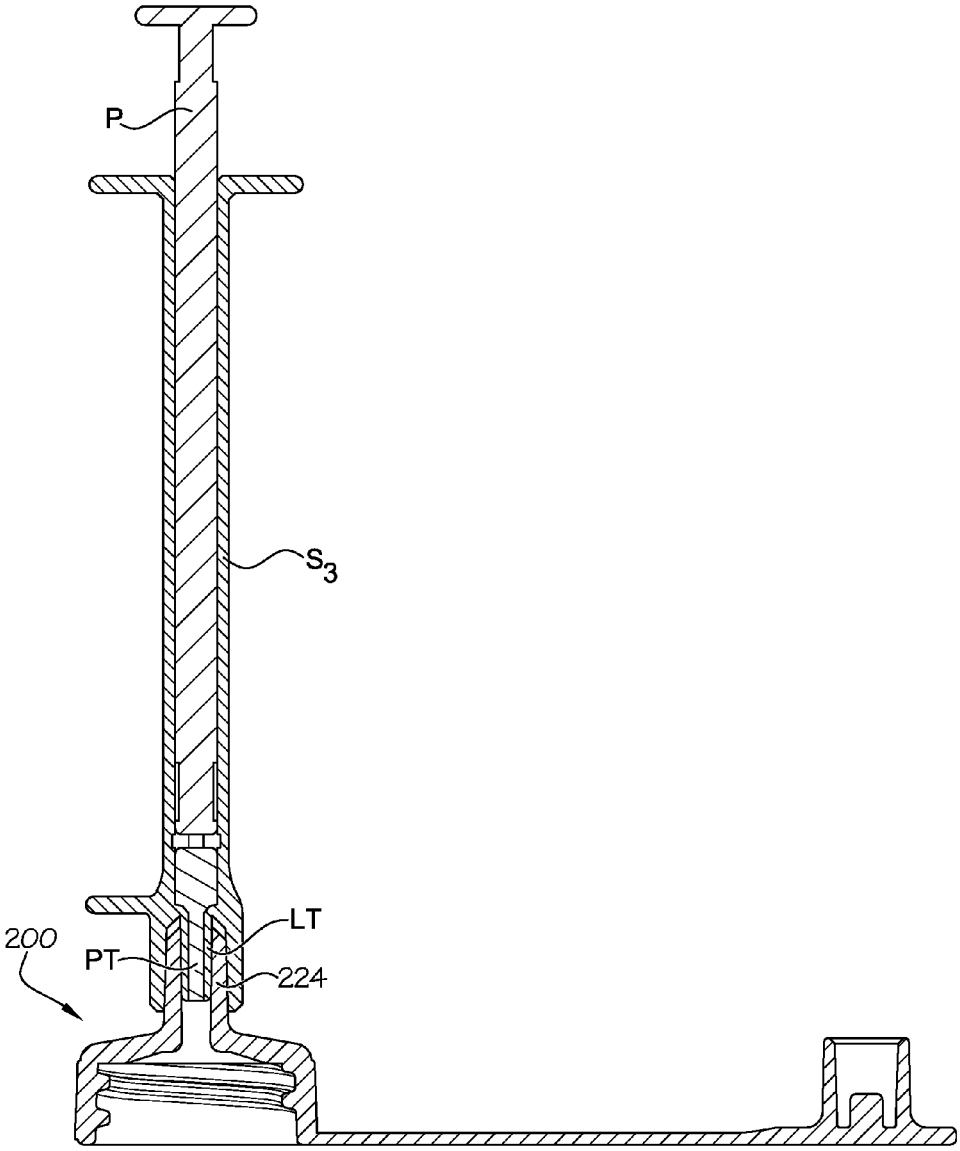
FIG. 10B is a plan view of the fluid transfer lid of FIG. 9 and a syringe having a low dose extension tip coupled to the fluid transfer lid.

FIGS. 9 and 10B show a syringe barrel S2 comprising an ENFit connector or female tip (according to ISO 80369-3 standards) coupled to the transfer port 224 of the fluid transfer lid 200. The female tip preferably provides a receptacle for receiving the transfer port 24, and preferably provides a slip/friction connection therebetween. According to one example form, the receptacle of the female tip is generally shaped similarly to the shape of the transfer port 24, and is more or less ISO 80369-3 compatible. Optionally, the receptacle may be shaped as desired to provide a sealed and an adjustably-tight connection therebetween. In typical example embodiments and according to ISO 80369-3 standards, the outer surface of the female tip comprises threads to detachably couple together mechanically by mating with a cooperating connector (as will be described below, see FIGS. 14-16) that is positioned around the transfer port 24. Optionally, as disclosed in FIG. 10B, the female tip of a syringe S3 can comprise a dosing control coupling or low dose tip LT extending within the lumen of the transfer port, for example, so that the lumen volume is substantially reduced to provide for a greater accuracy in dosing. Optionally, the syringe S3 comprises a low dose plunger comprising a generally elongate plunger tip PT for fitting within the lumen of the low dose tip LT. Preferably, according to some example embodiments, transferring fluids between the bottle B and the syringe S3 (via the lid 200) provides for greater accuracies in transferring a desired quantity of fluid therebetween. U.S. Provisional Patent Application Ser. No. 62/207,120 is incorporated herein by reference, and shows an example dosing control coupling for enteral fluid transfer.

Figure 11:
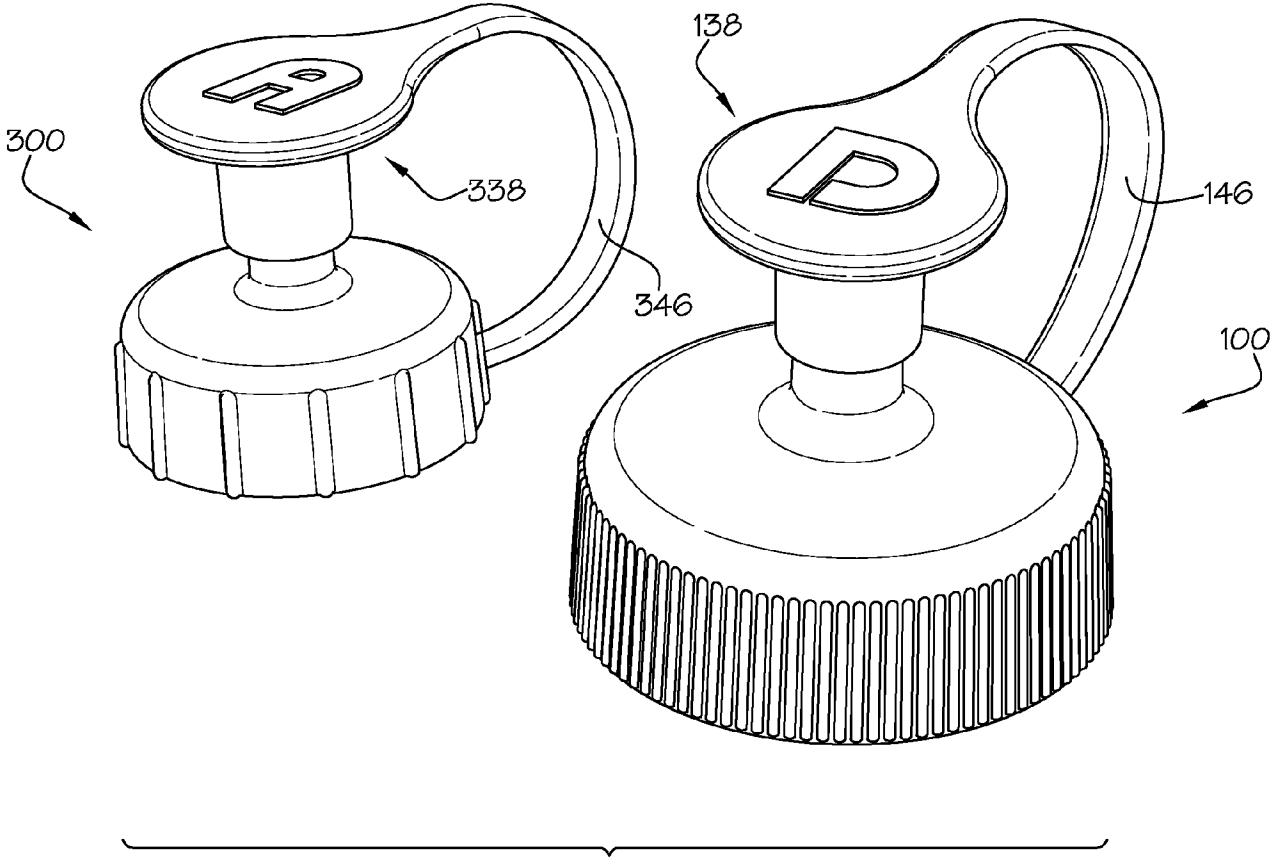
FIG. 11 shows side perspective views of the fluid transfer lids of FIGS. 5 and 8, and showing a tethered cap/cover coupled to a transfer port thereof.
Figure 12:
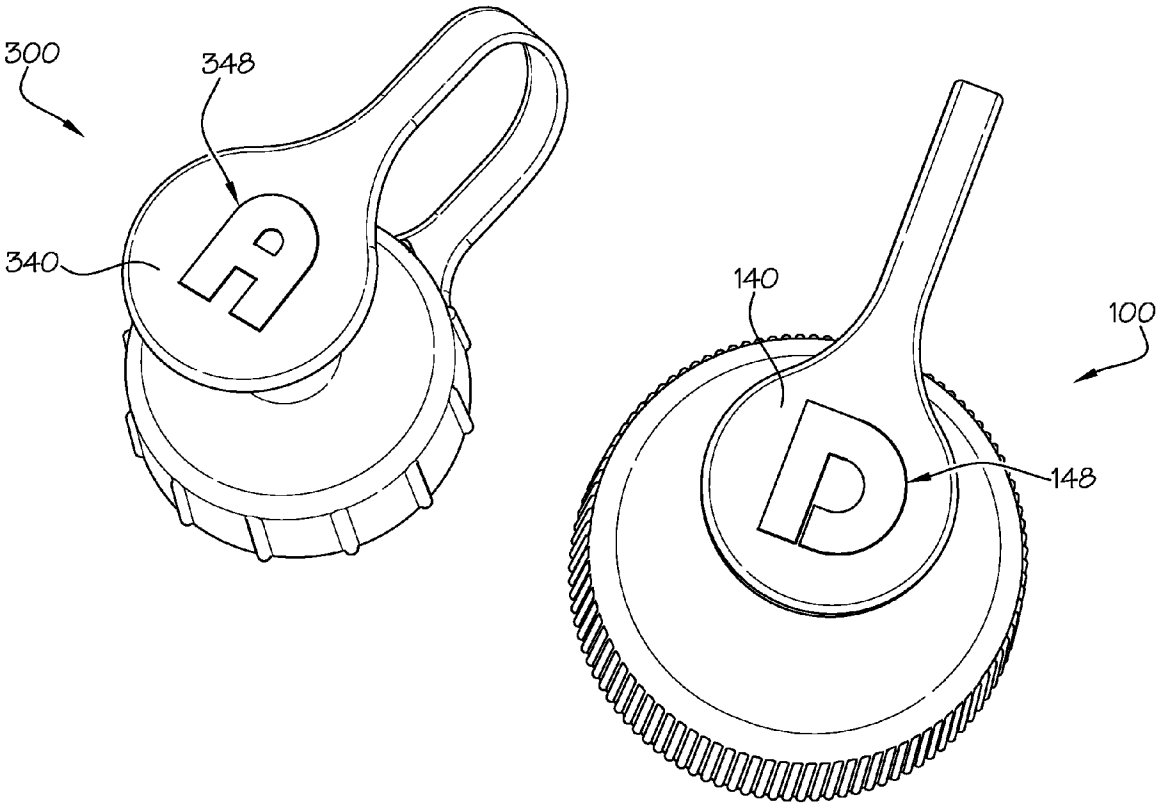
FIG. 12 shows a top perspective view of FIG. 11.

FIGS. 11 and 12 show the fluid transfer lids 100, 300 with the port closure cap 138, 338 removably coupled to the transfer port 24, for example, wherein the cover 42 sealingly engages the lumen 26 and forms a seal therein, thus forming releasable air-tight seal. In example forms, the tether 146, 346 is generally semi-flexible to provide for the port closure cap 138, 338 being easily movable to provide for sealingly engaging the transfer port 24. Optionally, indicia 148, 348 can be provided on a portion of the lip 140, 340 (or other portion) for indicating the size, dimensions, specifications, etc. of the fluid transfer lids 100, 300.

Figure 13:
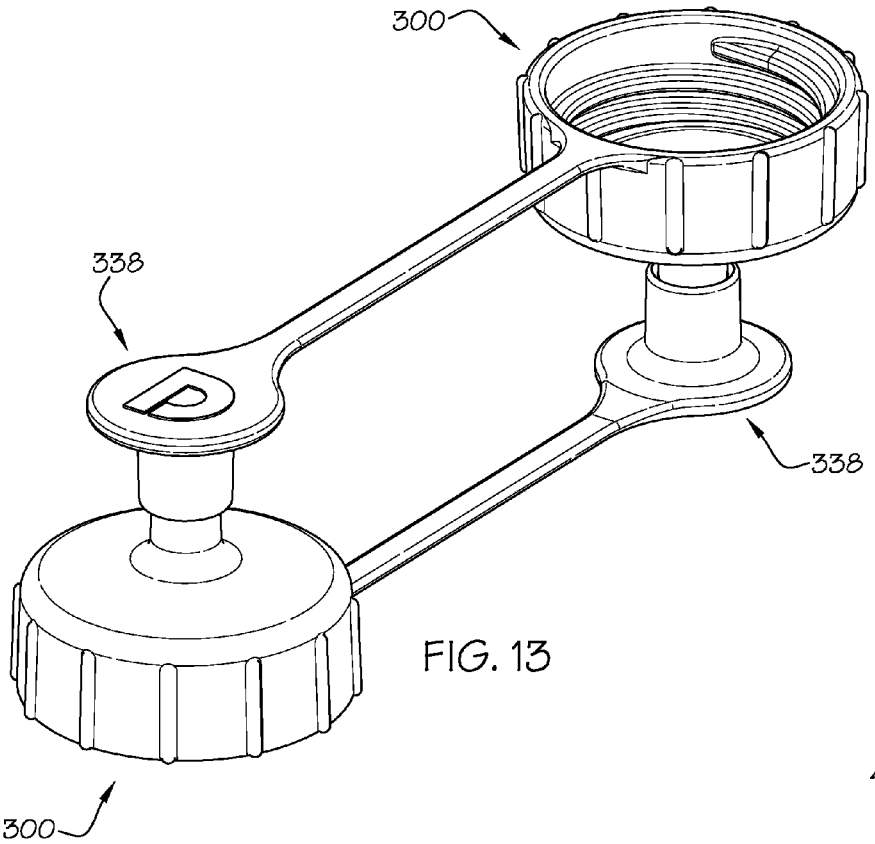
FIG. 13 shows a perspective view of a pair of fluid transfer lids coupled together according to another example embodiment of the present invention.

FIG. 13 shows a pair of fluid transfer lids 300 removably coupled together. As shown, the port closure cap 338 of a first of the fluid transfer lids 300 is removably coupled to the transfer port 324 of a second of the fluid transfer lids 300. Similarly, the port closure cap 338 of the second fluid transfer lid is removably coupled to the transfer port 324 of the first fluid transfer lid. In example embodiments, removably coupling the lids 300 together provides packaging benefits, more accurate inventory levels, organizational benefits, etc.

Figure 14:
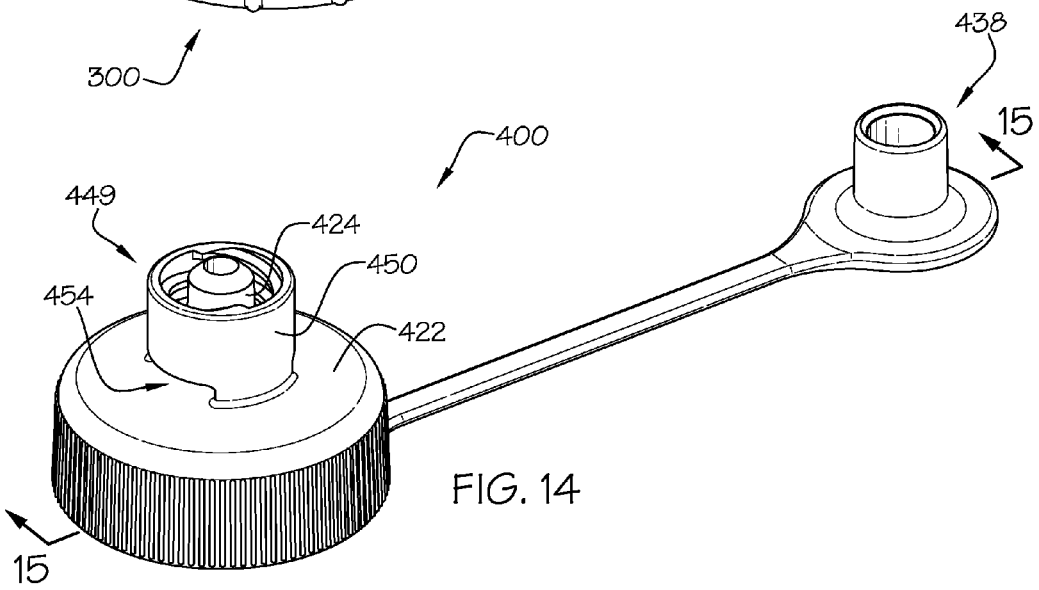
FIG. 14 shows a perspective view of a fluid transfer lid according to another example embodiment of the present invention.
Figure 16:
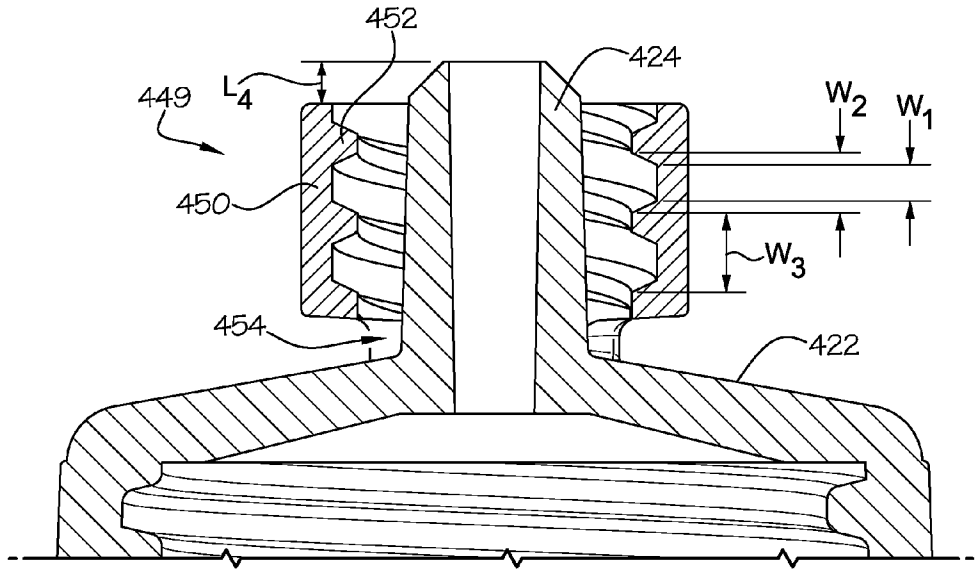
FIG. 16 shows a portion of the cross-sectional view of the fluid transfer lid of FIG. 15.
Figure 15:
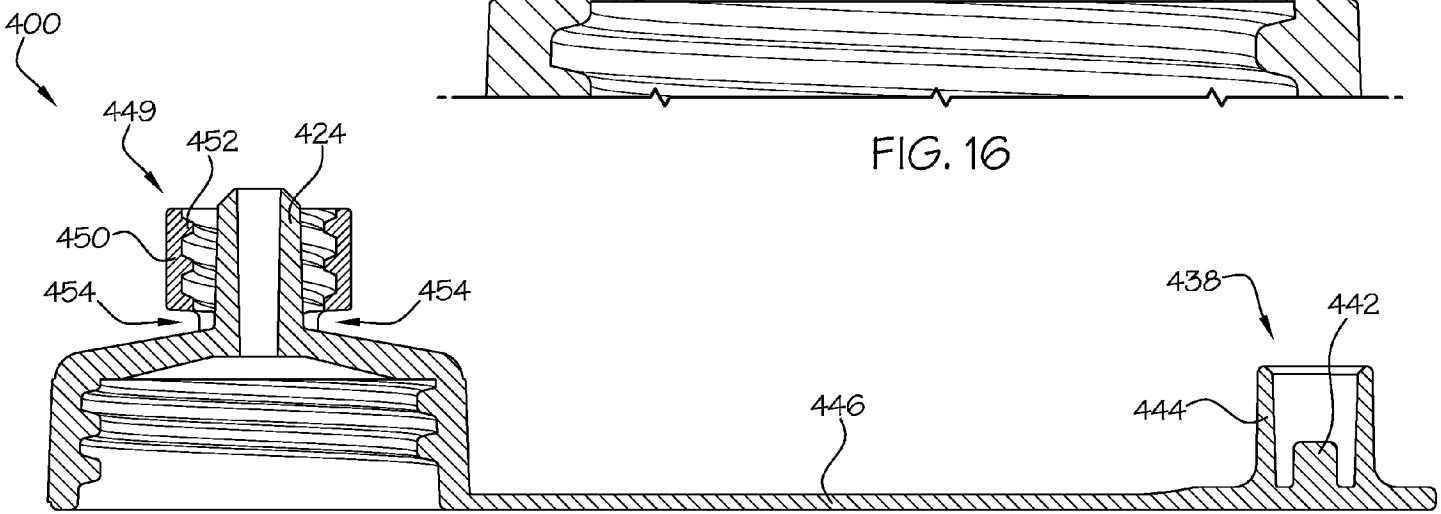
FIG. 15 shows a cross-sectional view of the fluid transfer lid of FIG. 14.

FIGS. 14-16 show a fluid transfer lid 400 according to another example embodiment of the present invention. In example forms, a cooperating connector 449 having an outer housing or collar 450 surrounds the transfer port 424, which is extending outwardly in the first direction from the top panel 422. In example forms, the outer housing or collar 450 projects from the top panel 422 to define a length L4 between the end of the outer housing 450 and the end of the transfer port 424. According to one example form, the length L4 is between about 1.00-1.20 millimeters, more preferably about 1.10 millimeters. To provide for fluid drainage and airflow ventilation, a portion of the outer housing 450 optionally comprises at least one vent/fluid drainage opening 454 (depicted as two openings 454). U.S. Non-provisional patent application Ser. No. 14/844,956 is incorporated herein by reference, and shows an example connector comprising vent openings formed in the outer housing. In alternate embodiments, the vent/fluid drainage opening(s) are omitted, and a closed collar surrounds the male nipple or coupling.

In example embodiments and according to ISO 80369-3 standards, the outer surface of the female tip of the syringe S comprises threads to detachably couple together mechanically by mating with a cooperating connector 449 (comprising threads 452 on an internal portion thereof) that is positioned around the transfer port 24, thereby making the connection therebetween ISO 80369-3 compliant. In example forms, the threads define a width W1 of the thread groove at the root, a width W2 of the thread groove at the crest, and the pitch W3 of the right-hand thread. According to one example embodiment, the width W1 is between about 1.05-1.25 millimeters, more preferably about 1.15 millimeters, the width W2 is between about 1.80-2.00 millimeters, more preferably about 1.90 millimeters, and the pitch W3 of the right-handed thread is between about 2.45-2.55 millimeters, more preferably about 2.50 millimeters.

While the invention has been described with reference to preferred and example embodiments, it will be understood by those skilled in the art that a variety of modifications, additions and deletions are within the scope of the invention, as defined by the following claims.

What is claimed is:

1. A fluid transfer lid comprising:

a nipple comprising a length and extending longitudinally along a first axis from a surface and comprising a chamfer formed at an end thereof, the nipple comprising an outside diameter near the chamfer of between about 5.36 millimeters to about 5.46 millimeters, and an outside diameter near the surface of between about 5.59 millimeters to about 5.69 millimeters;

a lumen extending generally axially along the first axis through the nipple, the lumen comprising a diameter of between about 0.1 millimeters to about 2.95 millimeters; and a cooperating connector having an outer housing surrounding the nipple, the outer housing being threaded on an internal portion thereof, the threads defining a root width between about 1.05-1.25 millimeters, a crest width between about 1.80-2.00 millimeters, and a pitch width between about 2.45-2.55 millimeters.

2. The fluid transfer lid of claim 1, further comprising a tethered closure cap attached to the lid for removable engagement and closure of the nipple.

3. The fluid transfer lid of claim 1, wherein the length of the nipple is between about 0.1 millimeters to about 1,000 millimeters.

4. The fluid transfer lid of claim 1, wherein the length of the nipple is about 6.82 millimeters.

5. A fluid transfer lid for engagement with a syringe comprising an ISO 80369-3 formatted female coupling and a dosing control coupling, the fluid transfer lid comprising a generally circular top panel and a transfer port comprising a length extending longitudinally along a first axis from a generally central position on the circular top panel outwardly in a first direction, and an attachment collar extending in a second and generally opposite direction from the top panel whereby an internal circumferential face thereof comprises one or more threads for releasably engaging corresponding threads of a container, wherein the transfer port comprises a chamfer formed at an end thereof and defines a lumen extending generally axially along the first axis therethrough, wherein the transfer port comprises an outside diameter near the chamfer of between about 5.36 millimeters to about 5.46 millimeters, wherein the transfer port comprises an outside diameter near the circular top panel of between about 5.59 millimeters to about 5.69 millimeters, wherein the lumen comprises a diameter of between about 0.1 millimeters to about 2.95 millimeters, and wherein the length of the transfer port is between about 0.1 millimeters to about 1,000 millimeters, and whereby the dosing control coupling comprises a generally centrally-positioned low dose tip for being received within the lumen of the transfer port when the syringe is coupled to the transfer port.

6. A fluid transfer lid comprising:

a generally circular top panel;

a nipple comprising a length and extending longitudinally along a first axis from a generally central position of the circular top panel, the nipple comprising a chamfer formed at an end thereof and a lumen extending generally axially along the first axis therethrough; and an attachment collar extending in a second direction from the circular top panel, an internal circumferential face thereof being threaded to releasably engage corresponding threads of a container, wherein the threads of the attachment collar define a root width between about 1.05-1.25 millimeters, a crest width between about 1.80-2.00 millimeters, and a pitch width between about 2.45-2.55 millimeters.

7. The fluid transfer lid of claim 6, wherein the nipple comprises an outside diameter near the chamfer of between about 5.36 millimeters to about 5.46 millimeters.

8. The fluid transfer lid of claim 6, wherein the nipple comprises an outside diameter near the circular top panel of between about 5.59 millimeters to about 5.69 millimeters.

9. The fluid transfer lid of claim 6, wherein the lumen comprises a diameter of between about 0.1 millimeters to about 2.95 millimeters.

10. The fluid transfer lid of claim 6, further comprising a tethered closure cap attached to the lid for removable engagement and closure of the nipple.

11. The fluid transfer lid of claim 6, wherein the length of the nipple is between about 0.1 millimeters to about 1,000 millimeters.

12. The fluid transfer lid of claim 6, wherein the length of the nipple is about 6.82 millimeters.

13. The fluid transfer lid of claim 6, wherein the attachment collar comprises an exterior circumferential face, and whereby one or more closely-spaced indentations or gripping features may be formed on the exterior circumferential face to assist a user in installing and removing the transfer lid onto and from the container.

14. The fluid transfer lid of claim 13, wherein the gripping features comprise generally closely-spaced elongate, ridge-like indentations formed along the exterior circumferential face.

15. The fluid transfer lid of claim 10, further comprising indicia on at least a portion of the tethered closure cap.

* * * * *